US007784709B1

(12) United States Patent
Williams et al.

(10) Patent No.: US 7,784,709 B1
(45) Date of Patent: Aug. 31, 2010

(54) FIRE FIGHTING NOZZLE AND METHOD INCLUDING PRESSURE REGULATION, CHEMICAL AND EDUCTION FEATURES

(75) Inventors: Dwight P. Williams, Vidor, TX (US); Dennis W. Crabtree, Beaumont, TX (US)

(73) Assignee: Williams Fire and Hazard Control, Inc, Mauriceville, TX (US)

( * ) Notice: Subject to any disclaimer, the term of this patent is extended or adjusted under 35 U.S.C. 154(b) by 1448 days.

(21) Appl. No.: 10/380,750

(22) PCT Filed: Sep. 27, 2000

(86) PCT No.: PCT/US00/26568

§ 371 (c)(1),
(2), (4) Date: Aug. 18, 2003

(87) PCT Pub. No.: WO02/26393

PCT Pub. Date: Apr. 4, 2002

Related U.S. Application Data

(63) Continuation-in-part of application No. 09/284,561, filed as application No. PCT/US98/20061 on Sep. 25, 1998, now Pat. No. 6,749,027.

(60) Provisional application No. 60/080,846, filed on Apr. 6, 1998.

(51) Int. Cl.
*B05B 17/04* (2006.01)

(52) U.S. Cl. ..... 239/11; 239/420; 239/424; 239/453; 239/456; 239/541; 239/533.1

(58) Field of Classification Search ..... 239/541, 239/451, 452, 453, 456, 459, 460, 420, 423, 239/424, 533.1, 11
See application file for complete search history.

(56) References Cited

U.S. PATENT DOCUMENTS

| | | | | |
|---|---|---|---|---|
| 2,207,758 | A * | 7/1940 | Rehse | 239/424 |
| 3,552,658 | A * | 1/1971 | Sons | 239/456 |
| 4,172,559 | A | 10/1979 | Allenbaugh | |
| 4,289,277 | A | 9/1981 | Allenbaugh | |
| 4,465,235 | A | 8/1984 | Allenbaugh | |
| 4,469,279 | A | 9/1984 | Allenbaugh | |
| 4,640,461 | A | 2/1987 | Williams | |
| 5,167,285 | A | 12/1992 | Williams | |

* cited by examiner

*Primary Examiner*—Christopher S Kim
(74) *Attorney, Agent, or Firm*—Shaper Iler LLP; Sue Shaper

(57) ABSTRACT

A selectively automatic fire fighting nozzle a method of use including adjustable means (ST) of limiting a range of automatic adjustment (B) of a discharge orifice of the nozzle, providing an option of selecting a constant pressure for a first fraction of a discharge window and selecting a relatively constant flow for a second fraction.

27 Claims, 6 Drawing Sheets

FIRE FIGHTING NOZZLE AND METHOD INCLUDING PRESSURE REGULATION, CHEMICAL AND EDUCTION FEATURES

This application is a continuation-in-part of U.S. Ser. No. 09/284,561 filed Apr. 15, 1999, now U.S. Pat. No. 6,749,027 a national stage application of PCT/US98/20061, filed Sep. 25, 1998, which in turn claims the benefit of the filing date of U.S. Provisional Application No. 60/080,846 filed Apr. 6, 1998. The contents of the applications are herein incorporated by reference in their entirety.

FIELD OF INVENTION

The invention relates to fire fighting and fire preventing nozzles and more particularly to nozzles for extinguishing or preventing large industrial grade fires including flammable liquid fires and/or for nozzles for vapor suppression, and includes improvements in pressure regulating, educting and chemical discharge features, as well as methods of use.

BACKGROUND OF INVENTION

Prior patents relevant to the instant invention include: (1) U.S. Pat. No. 4,640,461 (Williams) directed to a self educting foam fog nozzle; (2) U.S. Pat. No. 5,779,159 (Williams) directed to a peripheral channeling additive fluid nozzle; and (3) U.S. Pat. Nos. 5,275,243; 5,167,285 and 5,312,041 (Williams) directed to a chemical and fluid or duel fluid ejecting nozzle. Also relevant is the prior art of automatic nozzles, including (4) U.S. Pat. Nos. 5,312,048; 3,684,192 and 3,863,844 to McMilian/Task Force Tips and U.S. Pat. Nos. Re 29,717 and 3,893,624 to Thompson/Elkhart Brass. Also of note are U.S. Pat. No. 5,678,766 to Peck and PCT Publication WO 97/38757 to Baker.

Maintaining a constant discharge pressure from a nozzle tends to yield a constant range and "authority" for the discharge while allowing the nozzle flow rate to absorb variations in head pressure, as it were. In certain applications, such as vapor suppression, a fixed fire fighting nozzle is particularly useful if it self regulates to discharge at an approximately constant or targeted pressure. The discharge pressure tends to govern what is referred to as the "authority" of the discharge stream and to a certain extent the stream's range. A constant discharge pressure comes closer to a consistent delivery of a stream at a fixed range.

One specific application in which a self-regulating nozzle may be useful is in a fixed protection system that includes nozzles permanently stationed around locales subject to the leakage of toxic chemicals. Upon leakage, a permanently stationed configuration of constant pressure nozzles, possibly under remote control, could be activated to provide a predesigned curtain of water/fog to contain and suppress any toxic vapors. In such circumstances it may be optimal for nozzles to discharge their fluid with a (more or less) constant range and authority as opposed to having their discharge structured and regulated for a relatively constant flow rate, as is more typical for nozzles. Water/fog created with approximately constant range and authority, while operating under conditions of varying head pressure, will more reliably curtain a preselected region from a fixed locale.

Frequently nozzles are structured to deliver a pre-set gallons-per-minute flow rate, assuming a nominal head pressure, such as 100 psi at the nozzle. As the head pressure actually available to a nozzle in an emergency can vary, flow rate remains more consistent in such designs than range. Alternately structuring a nozzle to target and regulate discharge pressure lets flow rate vary with variations in delivered pressure while keeping range more constant.

The present invention discloses an improved pressure regulating nozzle designed to effectively discharge a fire extinguishing fluid at a pre-selected discharge pressure and range, up to a targeted flow rate, and thereafter to maintain relatively constant flow rate while discharge pressure and range are allowed to increase. A preselected discharge pressure, for example, would likely be approximately 100 psi, but the preselected pressure could vary, and might more optimally be selected to be approximately 120 psi. Likewise a targeted flow rate is selected. This selection of targeted flow rate need only be approximate. The inventive design combines the benefit value of maintaining range at low supply pressures while maintaining flow rate at higher supply pressures, thereby accommodating minimum range requirements on the one hand while more easily accommodating self-educting features for foam concentrates and a capacity to throw fluid chemicals such as dry powder on the other hand, where possible.

The invention includes enhanced eductive techniques, for both peripheral and central channeling, which enhanced eduction can be particularly helpful in automatic nozzles or when throwing chemicals such as dry powder.

A typical fire fighting nozzle may be designed to be adjusted to operate over a range of flows, such as 500 gallons-per-minute to 2000 gallons-per-minute, given a certain discharge pressure (typically assumed to be around 100 psi). In an automatic nozzle, to select and self regulate for pressure while allowing flow to vary, nozzle design incorporates a self-adjusting baffle or the like proximate the nozzle discharge. In general, when fluid pressure at such a baffle, sensed directly or indirectly, is deemed to lie below a selected pressure, the baffle is structured in combination with the nozzle body to "squeeze down" on the effective size of the discharge orifice. When pressure builds up at the baffle, sensed directly or indirectly, to reach or exceed a preselected pressure, the baffle is structured to cease squeezing down and, if necessary, to shift to enlarge the effective size of the nozzle discharge orifice. Enlargement continues, in general, until the discharge pressure reduces to the selected value. Adjustments in the size of the discharge port cause flow rate to vary but the discharge tends to have constant "authority" and range.

The instant invention achieves a hybrid pressure regulating and flow regulating system. Designs for flow and embodiments of automatic nozzles are themselves discussed in detail in the above applications incorporated herein by reference. This invention includes further improvements in self-adjusting nozzles. To review the basics of a nozzle, a fire fighting nozzle defines a conduit for a fire fighting fluid that terminates in a discharge orifice. The fire fighting fluid is usually water, and while it may be treated and discussed as water herein, it should be understood that nozzle technology is applicable to various fire fighting fluids. The conduit and discharge orifice structure are typically designed in combination to recover, to the extent practical, fire fighting fluid pressure available from the fluid source. Recovery of pressure affects range.

Given generally anticipatable supply ranges, in pressure and flow, for the fire fighting fluid (industry standard sources of pressurized water might be anticipated to vary between 75 psi and 150 psi,) nozzle body conduits and discharge orifices may be designed to define an effective, or practical, flow window. For instance, a "two and one-half inch" nozzle might be adjustable to effectively flow between 150 GPM and 600 GPM while a "sixteen inch" nozzle might be adjustable to effectively flow between 4,000 GPM and 16,000 GPM, both being affected by variations in supply pressure or quantity.

An adjustable discharge orifice, automatic or manual, is designed to be adjusted within a range of flow effectiveness of a nozzle body. Fluid flow rate through the nozzle may vary within a nozzle's effective flow window, again taking into account variations in source supply and pressure. Minimum limits on an effective flow window include a minimum effective "gap" size, or a minimum effective width of a typically annular discharge orifice. Below a certain "gap" size the thickness of the wall of water discharged diminishes such that the water wall tends to disintegrate and nozzle throw performance suffers. On the other end, a "gap" can get so large that the fixed conduit bore structure itself governs throw. There is thus a practical limit to the flow of water that can be efficiently flowed through a nozzle bore.

It is to be understood that although adjustable discharge orifices may be traditionally designed in terms of an adjustable baffle within a conduit, any element of a nozzle structure defining at lest in part the discharge orifice, including an outer wall portion, in theory could be an adjustable element. We refer to traditional designs for convenience, in regard to an adjustable baffle located in a conduit where the adjustment of the baffle forward and backward governs gap size. There is a range in which such adjustment is effective. The range is related to an effective or practical fluid flow window of the nozzle.

A given conduit and discharge orifice contribute to defining a "k" factor for a nozzle. Flow rate and discharge pressure are related by the formula: $r=k\sqrt{p}$, where r is the flow rate, p the discharge pressure and k the "k" factor. It can be seen that for a constant k, flow varies with the square root of pressure. With a fixed conduit and discharge orifice, discharge pressure p rises with increased supply pressure from the fluid source while flow rate "tends" to remain relatively constant, at least as compared to pressure, because it only increases with the square root of pressure.

"Automatic" nozzles have automatically adjustable discharge orifices. Automatically adjustable discharge orifices are typically designed to maintain a selected discharge pressure, such as 100 psi. In such automatic nozzles, there is typically a means for sensing discharge fluid pressure and a biasing means structured to adjust the discharge orifice (sometimes referred to as the "gap") until the sensed discharge pressure is approximately the preselected discharge pressure. (The word "approximately" is used herein throughout because automatic nozzle designs are only "approximately" accurate.) As a result of sensing and adjustment, a discharge orifice or gap is narrowed or widened so that the sensed discharge pressure is approximately the selected discharge pressure. When the discharge orifice or gap is narrowed, fluid flow rate through the nozzle is reduced. As the gap is widened, fluid flow rate through the nozzle is increased. As discussed above, however, if the discharge orifice of the nozzle were to remain fixed, the "k" of the nozzle would remain fixed and flow rate would "tend" to remain fixed while discharge pressure would vary with supply pressure. (Flow rate varies only with the square root of pressure.).

If a foam concentrate is to be metered into a fluid stream at a constant percent (eg 3%, or 6%), a relatively constant flow rate of the fluid stream is an advantage, as it allows a metering device on the foam concentrate to be set. Further, a relatively constant flow rate with a high discharge pressure may be desired in some circumstances. E.g. high pressure helps some concentrate to create a better foam. In a nozzle that discharges a chemical, such as a dry powder, within a fire fighting fluid, it may be desirable to limit fluid flow rate to avoid unnecessary wetting of the powder. Further, nozzles that adjust without limitation to produce a selected discharge pressure can waste water if there is a limited supply of water.

Thus, a relatively constant flow rate from a nozzle can be an advantage in several situations, but if the supply pressure is weak, or if a nozzle is set at a fixed distance from a fire, a relatively constant pressure may be an advantage. (Constant pressure tends to maintain range for the nozzle even though flow rate may vary). Within the duration of one fire, the relative importance of constant pressure and of constant flow rate can shift.

The hybrid, selectively automatic nozzle of the instant invention provides the best of two worlds. The adjustable stop (or any other such adjustable means) can be set so that an automatically adjustable discharge orifice is provided, as in an automatic nozzle, for flow rates up to a given point (in a nozzle's effective flow window). If supply pressure goes low, range can be maintained. However, if a targeted fluid flow rate within the nozzle is reached, a stop or the like causes the discharge orifice to cease adjusting. Now discharge pressure rises with supply pressure but fluid flow rate tends to remain approximately constant (again, rising only in proportion to the square root of the pressure). Metering foam concentrate in a preselected proportion is thus more reliable, with fixed flow rate.

SUMMARY OF THE INVENTION

The invention includes a selectively automatic fire fighting nozzle comprising a nozzle body having a conduit terminating in a discharge orifice. The discharge orifice is automatically adjustable within a range. The nozzle body includes a stop or the like, adjustable to limit a range of automatic adjustment of the orifice. This stop could be any adjustable means, simple or complex, for limiting the range of automatic adjustment of the orifice. Preferably the stop or adjustable means is located upon the nozzle body and divides a nozzle effective flow window such that the nozzle flows at variable flow rate/constant pressure for flow rates up to a targeted flow rate, and flows at variable pressure/constant flow rate as long as the targeted flow rate is needed.

The invention includes a method for operating an automatic fire fighting nozzle comprising (approximately) maintaining a selected fire fighting fluid discharge pressure for fluid flowing through the nozzle for flow up to a targeted rate and allowing discharge pressure to rise above selected discharge pressure as long as the targeted flow rate is reached. The selectively automatic fire fighting nozzle is also preferably a self-educting foam fog nozzle and even more preferably, a self-metering self-educting foam fog nozzle.

BRIEF DESCRIPTION OF THE DRAWINGS

A better understanding of the present invention can be obtained when the following detailed description of preferred embodiments are considered in conjunction with the following drawings, in which.

Figure 1B:
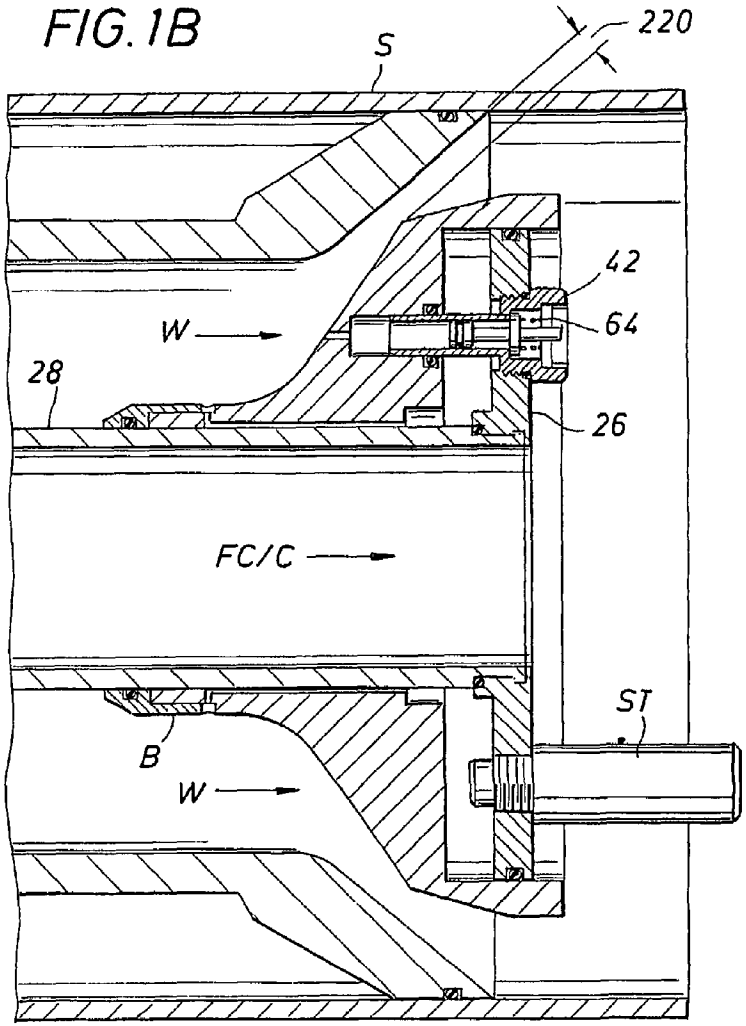
FIGS. 1A, 1B, 1C and 1D illustrate in cutaway an embodiment for a selectively automatic fire fighting nozzle, with flow stop illustrated in FIGS. 1A, 1B and 1C and with no flow stop, full flow window, illustrated in FIG. 1D.

The drawings are primarily illustrative. It should be understood that structure may have been simplified and details omitted in order to convey certain aspects of the invention. Scale may be sacrificed to clarity.

DETAILED DESCRIPTION OF THE PREFERRED EMBODIMENTS

In general, a nozzle having an "adjustable" baffle in order to discharge fire extinguishing fluid at a selected pressure uses a biasing means opposing a natural movement of an adjustable baffle outwards in response to fluid pressure, which outward movement tends to open the effective size of a discharge orifice. Most simply, the biasing means biases with a backward force equal to the force of the desired or selected fluid pressure upon the forward baffle surfaces. Hence baffle forward movement balances against baffle backward bias pressure at the selected pressure. Forward baffle surfaces are surfaces that the baffle presents to the fire extinguishing fluid moving through and out of the discharge port.

In theory, the biasing force could be provided by a spring that, over the adjustment range of the baffle between its end points, which may be no more than approximately one half of an inch, presents an essentially constant biasing force at the selected pressure. The selected pressure might well be 100 psi. Alternately, an adjustable bafflehead could be designed defining a chamber within the bafflehead and presenting forward and backward surfaces against which the primary fire extinguishing fluid could act. It is understood that the chamber defined within the bafflehead would have means for permitting a portion of the fire extinguishing fluid to enter the chamber. In such designs the effective backward pressure surface area would usually exceed the effective forward pressure surface area of the baffle. The fluid pressure within the baffle, however, is expected to be at least slightly less than the pressure exerted on forward facing baffle surfaces. Such tends to counter the fact that the backward pressure surface area presented to the fluid within the baffle, at least in preferred embodiments herein, exceeds the forward pressure surface area presented on the baffle. In such manner the fluid within the baffle acts against a greater surface area and, although lower in value, can potentially drive the baffle backwards against the flow of fluid through the nozzle. Anticipating the difference between the pressures, without and within the baffle, at different source pressures, and anticipating the difference in the effective areas presented to the fluid pressures at different head pressures and flow rates, leads to a design for a "balanced baffle" at a targeted fluid pressure. Spring mechanisms can always be added, it should be understood, to augment the biasing forces provided by the primary fire extinguishing fluid pressure upon the bafflehead forward and backward surfaces. If or when baffle adjustment results in a variation of the volumes of the defined baffle chamber, as by the baffle sliding over a fixed piston, relief will be provided to vent fluid from inside the chamber.

Reference is made to the patent applications incorporated herein by reference for more complete discussions and illustrations. Those applications disclose in particular the use of at least one relief valve in order to heighten the accuracy and speed of balance and to lessen undue hunting or hysteresis. A relief valve vents fluid pressure from one or the other side of the baffle, preferably from within the baffle chamber, when fluid pressure varies from target pressure. Such venting typically causes the baffle to move, as in an illustrated case, outward toward one of the baffle location end points. A movement outward or toward the outward end direction will cause a decrease in the fluid pressure upon the baffle. Such decrease in fluid pressure could cause the relief valve to again close, permitting again the buildup of fluid pressure upon the back side of the baffle. The build up of fluid pressure upon the back side of the baffle should help adjust the baffle toward a balanced position where the fluid pressure on the forward surfaces of the baffle balances the fluid pressure on backward surfaces of the baffle, including taking into account other biasing elements such as a continuously "bleeding" relief valve and any springs utilized in the design.

The relief valves illustrated sense either rather directly the primary fire extinguishing fluid pressure presented to forward baffle surface areas in the nozzle or sense more indirectly a more secondary fluid pressure generated within a chamber within the baffle. The difference between such designs, or other designs that could occur to those of skill in the art, can largely be a matter of design choice and simplicity of engineering.

One function selected for a relief valve could be to assist in achieving the situation where a balanced pressure position is consistently approached from the same direction, which could either be the moving outwardly or the moving inwardly the baffle. Such a design may facilitate engineering a higher degree of accuracy around the balance point with less hunting and greater speed in achieving balance.

The present invention, as in the referenced and incorporated applications, also teaches improved self educting features that are particularly helpful and useful in a pressure regulating nozzle, as well as enhanced educting and pressure regulating designs that are useful when throwing fluid chemical such as dry powder, with or without an automatic nozzle.

In operation, a self-adjusting automatic feature depends upon an adjustable baffle that adjusts, at least in significant part, in response to primary fire fighting fluid pressure presented both to a forward and a reverse side of a baffle surface. In such a manner the baffle operates at least in part as a two-way piston seeking a balanced pressure position. The nozzle fluid provides a fluid pressure to act against both sides of the baffle. The pressure acting in the reverse direction will be at least a function of the forward pressure. Preferably the reverse pressure surface of the baffle will be larger than the forward pressure surface of the baffle. It is recognized that the forward pressure surface of the baffle may in fact change and be a function of pressure and fluid flow through the nozzle and baffle design and nozzle size. Although it would be possible to design a baffle having a balanced position where the targeted pressure forward times the forward pressure surface equals the reverse pressure times the reverse pressure surface, such a balancing technique is difficult to effect in practice. Hence, preferred embodiments utilize at least one relief valve. Preferred embodiments further utilize a relief valve to relieve pressure in the reverse direction. In preferred embodiments the area of the reverse pressure surface is greater than the area of the forward pressure surface. Thus, in preferred embodiments when the relief valve is closed, in general, the reverse pressure times the area of the reverse pressure surface will be greater than the forward pressure times the area of the forward baffle surface. This will dictate that for significant values of forward pressure the nozzle is biased closed. As the baffle closes, the pressure forward at the bafflehead will tend toward its maximum deliverable pressure in the nozzle. At some point near the forward target pressure, one or more relief valves begin to open relieving pressure on the reverse side of the baffle and allowing the bafflehead to balance onto open and adjust outward. Preferably the relief valve builds in a degree of adjustability such that the relief valve can select a partially opened position and settle upon such position without undue hunting and wherein the target pressure times the forward surface at the target pressure equals the reverse pressure times the reverse pressure surface area taking into account the degree of openness of the relief valve system.

Figure 1A:
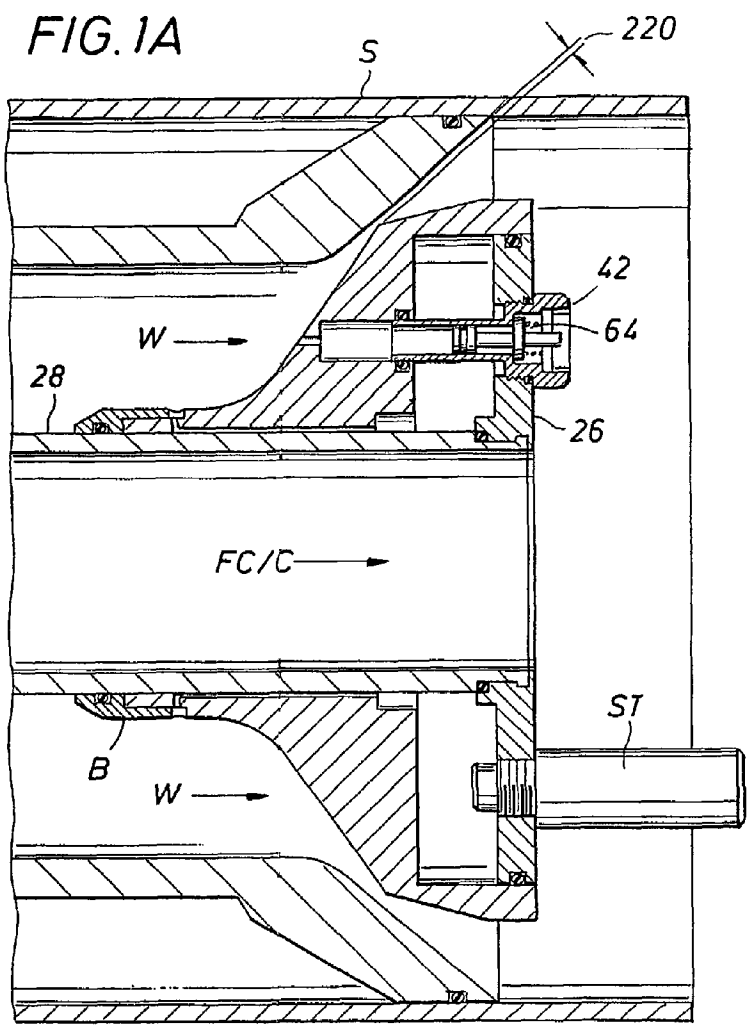
Figure 1C:
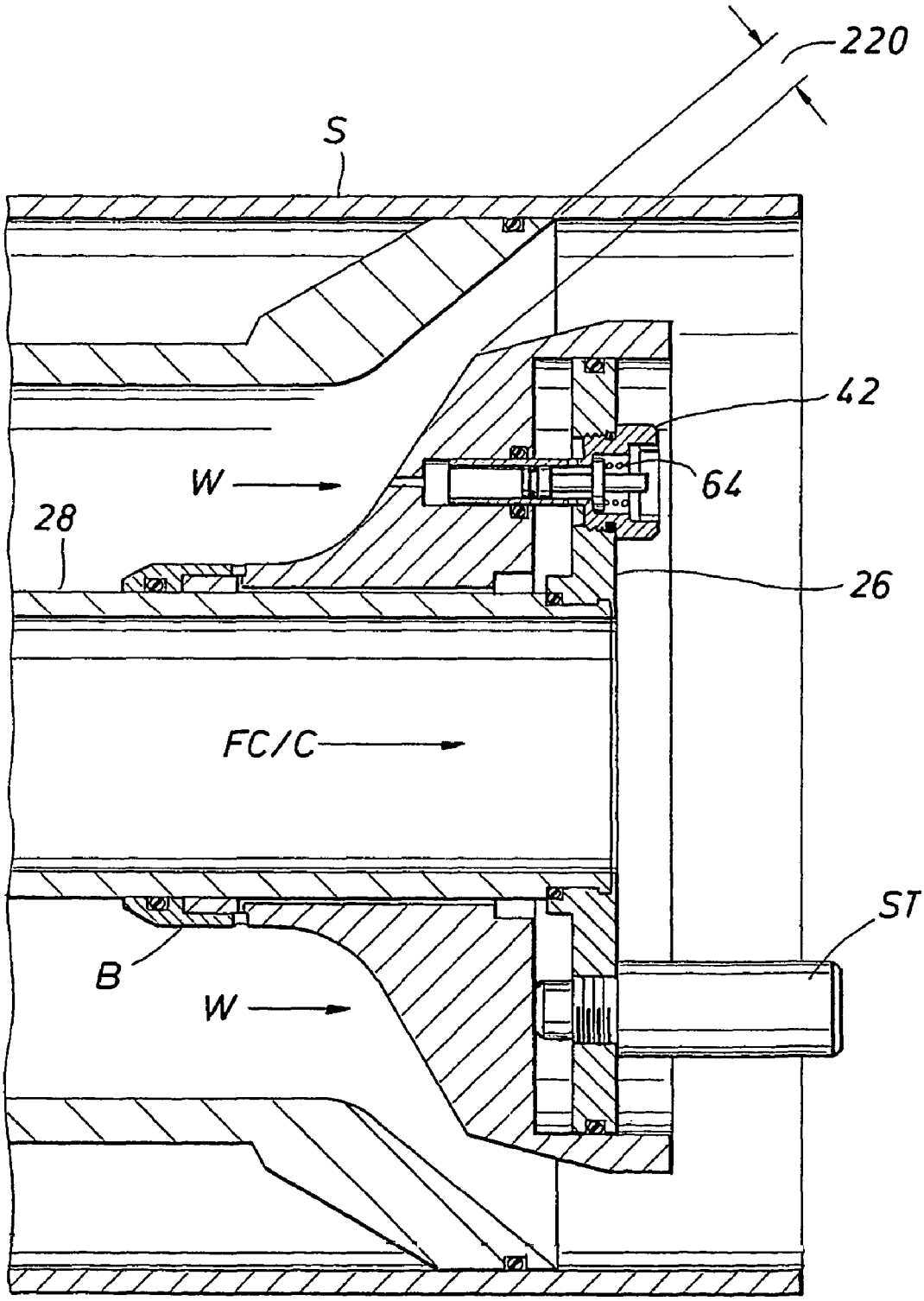
Figure 1D:
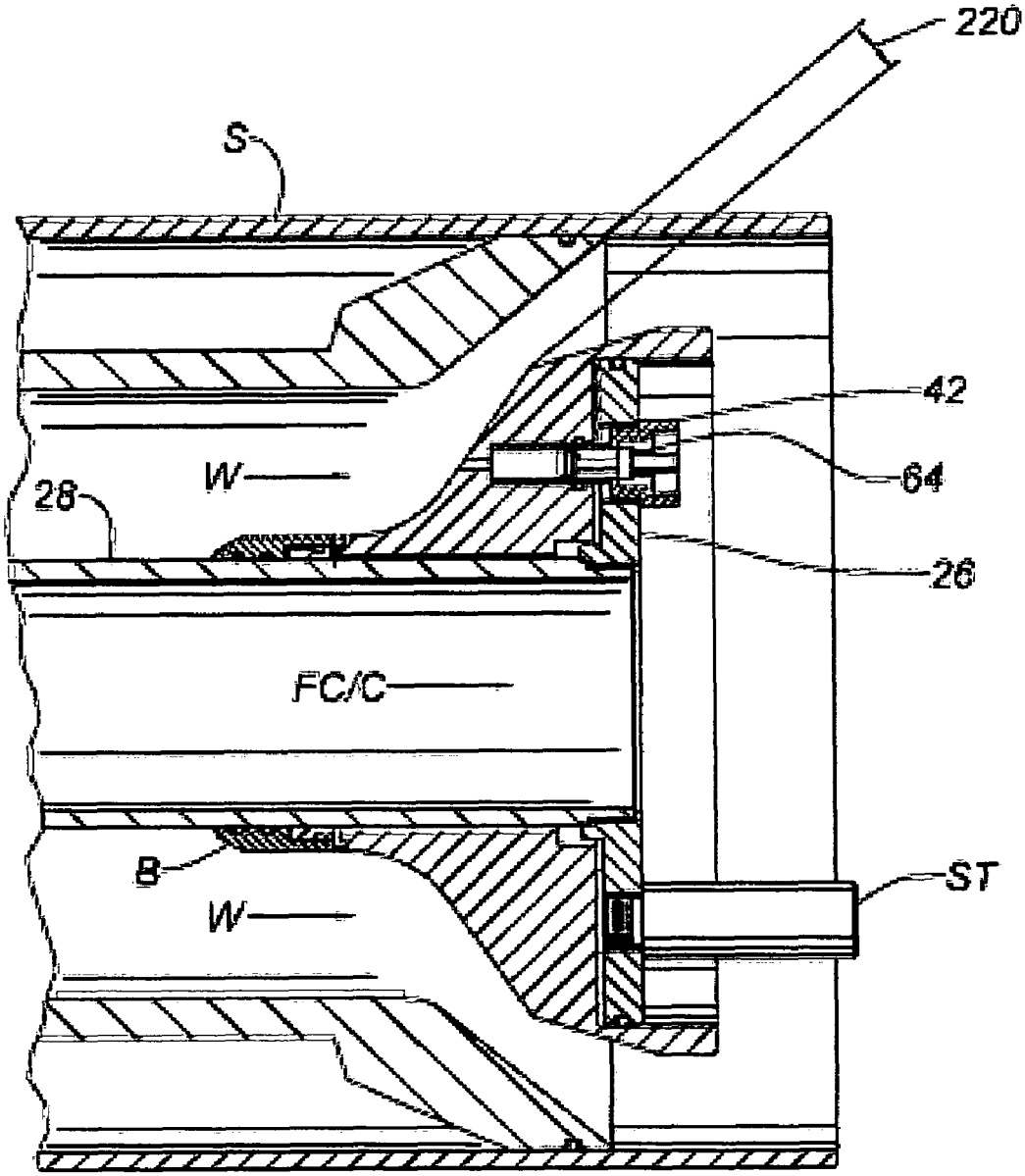

FIGS. 1A, 1B, 1C, 2A, 2B, 3A and 3B illustrate embodiments of the instant invention, a selectively automatic fire fighting nozzle. The embodiment of FIGS. 1A-C, 2A, B and 3A herein are analogous to the embodiments of FIG. 3A, FIG. 3D, FIGS. 4C, 4D, 5A, 5B, 5C and 6, of the applications referenced and incorporated above. The instant FIGS. 1A, 1B and 1C illustrate a pilot valve 42 situated in piston 26. Floating bafflehead B moves outward, as controlled by pilot valve 42, to the right to widen gap 220. FIG. 1A illustrates a gap 220 suitable to flow 1,000 GPM while FIG. 1B illustrates a gap 220 suitable to flow 2,000 GPM and FIG. 1C illustrates a gap 220 suitable to flow 4,000 GPM. Water W flows through the nozzle body in FIGS. 1 from left to right. Foam concentrate FC or chemical C flows through the foam/chemical tube 28. New in FIGS. 1A, 1B and 1C, as opposed to FIGS. 3-6 of the prior applications, is flow stop ST. The flow stop is shown set for a "4,000 GPM" gap 220 size, illustrated in FIG. 1C. In the preferred embodiment shown, flow stop ST is conveniently affixed to a portion of piston 26. When an inside surface of floating bafflehead B reaches or contacts flow stop SD, floating bafflehead B ceases to further adjust outward or to the right. If water supply and pressure increases, the gap will remain as in FIG. 10C. Flow rate will remain approximately 4,000 GPM while discharge pressure will rise. Pilot valve 42 is presumed to be set at some pre-selected pressure such as 100 psi. As in previous nozzles, when the water supply and pressure from the source produce a pressure at the bafflehead greater than the pre-selected pressure, pilot valve 42 leaks fluid from the baffle chamber and floating bafflehead B moves out, or downstream, widening the gap created between the floating bafflehead B and the nozzle body. In all three drawings pattern control sleeve S is shown, as is customary for a fog nozzle. For clarity the sleeve is always shown in the "fog" pattern position.

Figure 2A:
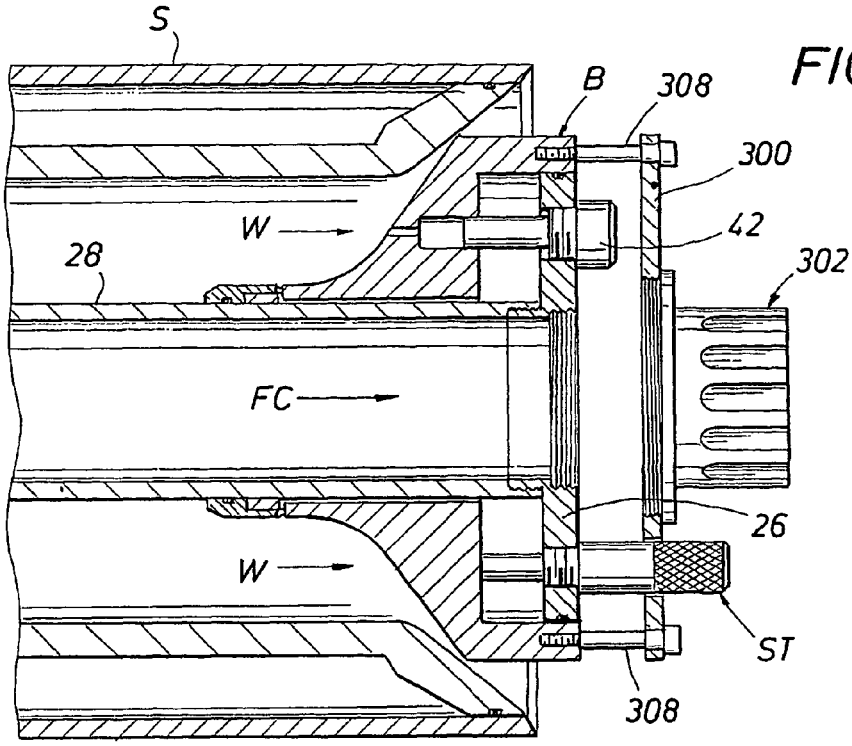
FIG. 2A illustrates an embodiment of a selectively automatic fire fighting nozzle having a flood plate, suitable for only foam educting technique.
Figures 1, 2B:
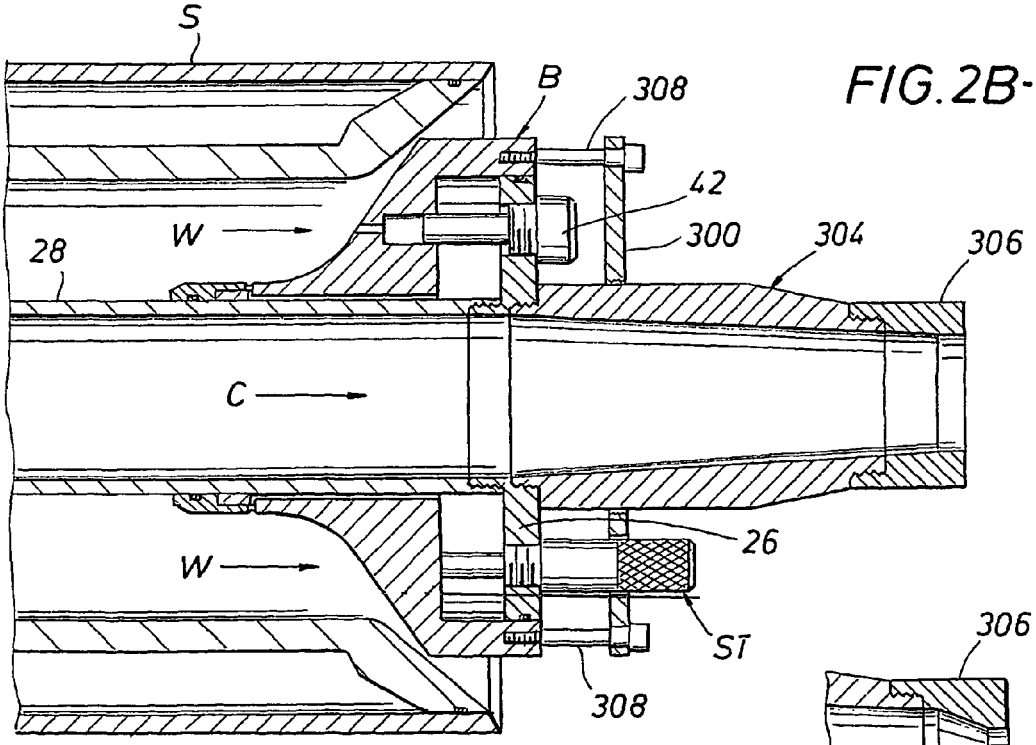
FIG. 2B illustrates an embodiment of a selectively automatic fire fighting nozzle suitable for one embodiment of a chemical application.
Figures 2, 2B:
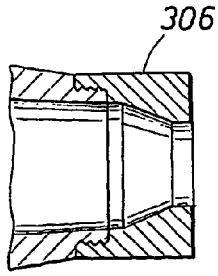
Figures 1, 3A:
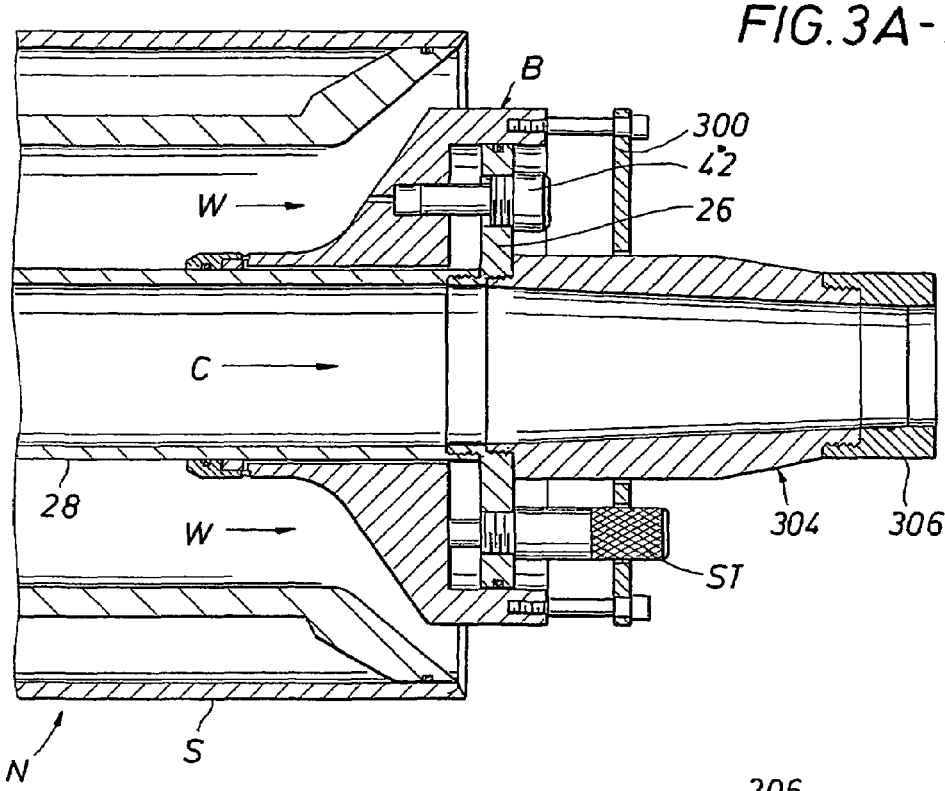
FIGS. 3A and 3B illustrate a set of stops structured for a nozzle to target different flow rates.
Figures 2, 3A:
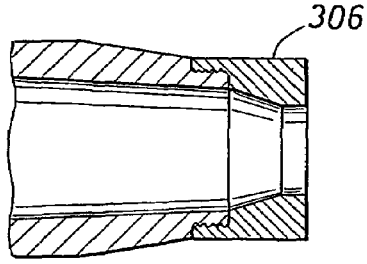

FIGS. 2A and 2B illustrate embodiments similar to FIGS. 1A-1C. FIGS. 2A, 2B, 3A and 3B show a flood plate 300 attached by pins 308 to floating bafflehead B. The flood plate can be adjusted for a foam application, as in FIGS. 2A and 3B. In this instance plug 302 is attached to flood plate 300. Alternately, the nozzle can be adjusted for a hydrochemical application, as in FIGS. 2B and 3A, in which case chemical extension tube 304 is affixed to flood plate 300. Adjustable chemical flow chokes 306 are usually provided with a chemical extension tube 304. The nozzle embodiment of FIGS. 2B and 3A is thus adapted to throw not only water but dry chemical. The nozzle embodiment of FIG. 2A is adapted to throw not only water but foam concentrate. In FIGS. 2A and 2B a flow stop ST illustrated in FIGS. 3A and 3B is shown achieving a full closed position for the nozzle. Alternate flow stops ST can installed, by the design of the preferred embodiment to permit bafflehead B to move out into the positions illustrated in FIGS. 1A, 1B, 1C, 3A and 3B.

Figures 3, 3A:
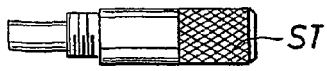
Figures 3, 3A, 4, 5, 6:
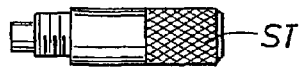
Figures 3, 3A, 4:
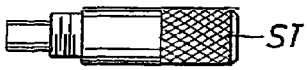
Figures 3, 3A, 4, 5, 6, 7:
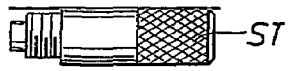
Figures 3, 3A, 4, 5:
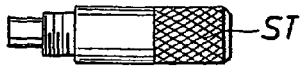
Figures 3, 3A, 4, 5, 6, 7, 8:
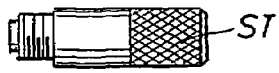
Figures 1, 3B:
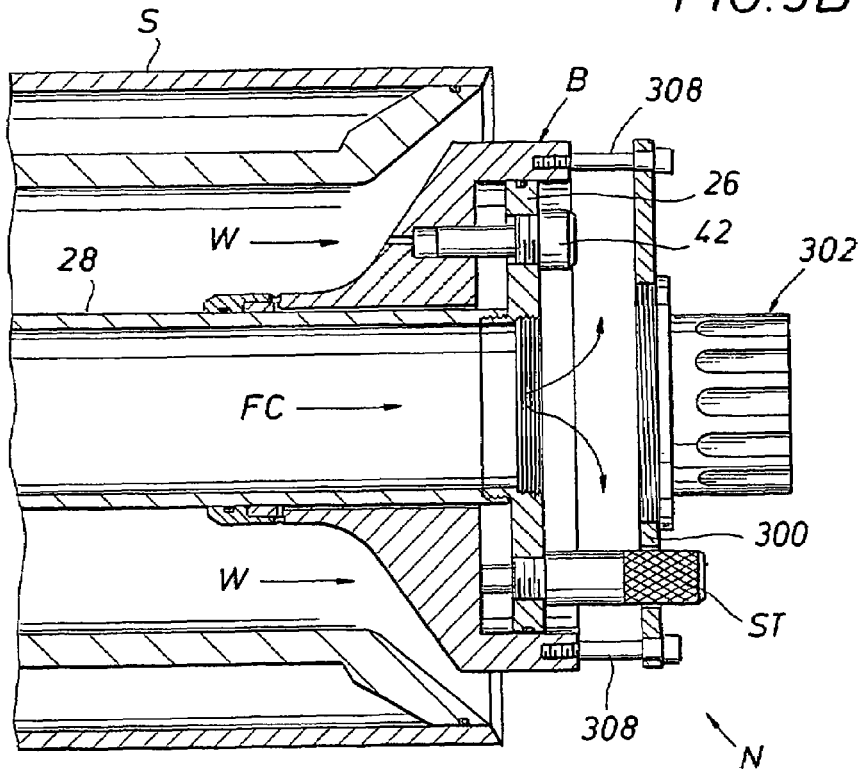
Figures 2, 3B:
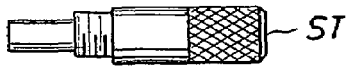
Figures 3, 3B, 4, 5:
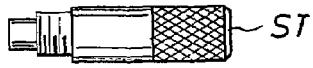
Figures 3, 3B:
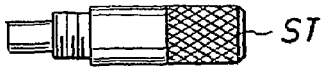
Figures 3, 3B, 4, 5, 6:
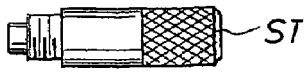
Figures 3, 3B, 4:
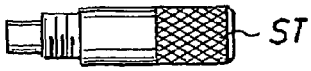
Figures 3, 3B, 4, 5, 6, 7:
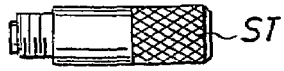

In the preferred embodiment illustrated in FIG. 3 a set of stops ST are provided, each stop with a different shank length to govern a different gap size. Alternately, however, one stop could be provided adjustable as by screwing. Other equivalent means could be utilized to place a limit on a floating bafflehead or the like in its forward or downstream movement.

The nozzle show in FIGS. 2A and 3B are adaptable to be used with a self-metering self-educting nozzle as disclosed more fully in the above referenced and incorporated patent application.

In operation, the adjustable nozzle would be presumed to set to target a preselected discharge pressure such as 100 psi. The operator, as in the preferred embodiment of FIGS. 3 and 3B, will select a stop that approximately targets a given flow rate. The operator will affix the stop in the position provided in the fixed piston. The floating bafflehead will then maintain a fixed pressure until the bafflehead is stopped by abutting the end of the flow stop that extends through the piston into the baffle chamber. Thereafter, if supply pressure rises and supply flow is adequate, the discharge pressure at the nozzle will rise. The gap will remain constant and the flow rate will remain approximately constant.

While there are shown and described present preferred embodiments of the invention, it is to be distinctly understood that the invention is not limited thereto, but many otherwise variously embodied and practiced within the scope of the following claims.

The foregoing disclosure and description of the invention are illustrative and explanatory thereof, and various changes in the size, shape, and materials, as well as in the details of the illustrated system may be made without departing from the spirit of the invention. The invention is claimed using terminology that depends upon a historic presumptive presentation that recitation of a single element covers one or more, and recitation of two elements covers two or more, and the like.

What is claimed is:

1. A selectively automatic, dual fluid fire fighting nozzle, comprising:

a body portion of the nozzle defining a fire fighting fluid conduit terminating in an adjustable discharge orifice, the fire fighting fluid conduit and discharge orifice surrounding an attached dry chemical or foam concentrate conduit and chemical or foam discharge orifice;

the adjustable discharge orifice defined, at least in part, by elements that relatively adjust over an available range and that relatively adjust automatically to maintain a selected firefighting fluid discharge pressure over at least portion of the range; and a stop, connected to the nozzle body, at or downstream of the adjustable fire fighting fluid discharge orifice, adjustable to further limit, within the available range, the range of automatic relative adjustment between orifice defining elements.

2. The apparatus of claim 1 wherein a flow window is defined by an effective range of adjustment of the adjustable discharge orifice and wherein the stop is adjustably located on the nozzle body to divide the flow window such that the nozzle flows at a variable flow rate and at approximately constant pressure for a portion of the flow window and at a variable pressure and relatively constant flow rate otherwise.

3. The apparatus of claim 1 wherein the orifice defining elements include a floating baffle and the stop limits forward motion of the floating baffle.

4. A selectively automatic, dual fluid fire fighting nozzle, comprising:

a body portion of the nozzle defining a fire fighting fluid conduit terminating in an adjustable discharge orifice, the fire fighting fluid conduit and adjustable discharge orifice surrounding an attached dry chemical or foam concentrate conduit and chemical or foam discharge orifice;

the adjustable discharge orifice adjustable within an available range and automatically adjustable to maintain a selected fire fighting fluid discharge pressure over at least a portion of the range; and adjustable means for further limiting the range of automatic adjustment of the fire fighting fluid discharge orifice within the available range at or downstream of the adjustable fire fighting fluid discharge orifice.

5. A method of operating an automatic, dual fluid fire fighting nozzle having an automatically varying discharge orifice, the nozzle subject to varying supply pressures, comprising:

targeting a flow rate less than a maximum possible flow rate for the nozzle operating at a standard supply pressure, wherein said maximum possible flow rate corresponds to a maximum opening of the discharge orifice provided by nozzle structure, by adjusting a stop located at or downstream of the discharge orifice;

maintaining approximately a selected fire fighting fluid discharge pressure for fire fighting fluid flowing through the nozzle for fluid flow rates up to approximately the targeted flow rate; and allowing fluid discharge pressure to rise above the selected discharge pressure while maintaining (approximately) fluid flow rate upon reaching the targeted flow rate; and discharging dry chemical or foam concentrate through a conduit of the nozzle surrounded by the fire fighting fluid conduit and varying discharge orifice.

6. The method of claim 5 that includes educting foam concentrate into the nozzle.

7. The method of claim 6 that includes adjustably metering foam concentrate into the nozzle as the discharge orifice adjusts.

8. A selectively automatic, dual fluid fire fighting nozzle, comprising:

a body portion of the nozzle defining a fire fighting fluid conduit terminating in an adjustable discharge orifice, the fire fighting fluid conduit and discharge orifice surrounding an attached dry chemical or foam concentrate conduit and chemical or foam discharge orifice;

the adjustable discharge orifice defined at least in part by elements that relatively adjust, over an available range and that relatively adjust automatically to maintain a selected fire fighting fluid discharge pressure over at least a portion of the range;

a stop connected to the nozzle body, at or downstream of the adjustable fire fighting fluid discharge orifice, adjustable to further limit a range of automatic relative adjustment between adjustable discharge orifice defining elements within the available range; and wherein a flow window is defined by an effective range of adjustment of the adjustable discharge orifice and wherein the stop is adjustably located on the nozzle body to divide the flow window such that the nozzle flows at a variable flow rate and at approximately constant pressure for a lower flow rate portion of the flow window and at a variable pressure and relatively constant flow rate otherwise.

9. A selectively automatic, dual fluid fire fighting nozzle, comprising:

a body portion of the nozzle defining a fire fighting fluid conduit terminating in an adjustable discharge orifice, the fire fighting fluid conduit and discharge orifice surrounding an attached dry chemical or foam concentrate conduit and chemical or foam discharge orifice;

the adjustable discharge orifice defined at least in part by elements that relatively adjust, over an available range and that relatively adjust automatically to maintain a selected fire fighting fluid discharge pressure over at least a portion of the range;

a stop connected to the nozzle body, at or downstream of the fire fighting fluid adjustable discharge orifice, adjustable to further limit range of automatic relative adjustment between adjustable discharge orifice defining elements within the available range; and wherein the adjustable discharge orifice defining elements include a floating baffle and the stop limits forward motion of the floating baffle.

10. A method of operating an automatic, dual fluid fire fighting nozzle subject to varying supply pressures comprising:

maintaining approximately a selected fire fighting fluid discharge pressure for fire fighting fluid flowing through the nozzle for fluid flow rates up to a targeted flow rate, by adjusting a stop located at or downstream of a fire fighting fluid automatically adjustable discharge orifice;

allowing fluid discharge pressure to rise above the selected discharge pressure while maintaining (approximately) fluid flow rate upon reaching a targeted flow rate;

allowing said pressure to rise by limiting the adjustment of an automatically adjustable discharge orifice within an available range of adjustment of the orifice; and discharging dry chemical or foam concentrate through a conduit and chemical or foam discharge orifice in the nozzle surrounded by the fire fighting fluid conduit and adjustable discharge orifice.

11. A selectively automatic, dual fluid fire fighting nozzle, comprising:

a nozzle body defining a fire fighting fluid conduit terminating in a variable discharge orifice, the orifice varying between a minimum and maximum opening at least in part in response to variation in fire fighting fluid pressure so as to maintain a selected fire fighting fluid discharge pressure, the fire fighting fluid conduit and discharge orifice surrounding an attached dry chemical or foam concentrate conduit and chem/foam discharge orifice; and nozzle elements, at least in part adjustable, at or downstream of the fire fighting fluid variable discharge orifice, providing a selectively variable range for the maximum orifice opening.

12. The apparatus of claim 11 wherein a maximum of the selectively variable range for the maximum orifice opening defines a flow window and wherein the nozzle elements include a stop adjustably located on the nozzle body, at or downstream of the fire fighting fluid variable discharge orifice, to define a maximum orifice opening so as to divide the flow window such that the nozzle flows at a variable flow rate and at approximately constant pressure for a portions of the flow window and at a variable pressure and relatively constant flow rate otherwise.

13. The apparatus of claim 11 wherein a flow window is defined by the adjustable discharge orifice and wherein the stop is selectively adjustably located on the nozzle body to divide the flow window such that the nozzle flows at a variable flow rate and at approximately constant pressure for a portion of the flow window and at a variable pressure and relatively constant flow rate otherwise.

14. The nozzle of claim 11 wherein the nozzle elements include a floating baffle and a stop and wherein the stop limits forward motion of the floating baffle.

15. A selectively automatic, dual fluid fire fighting nozzle, comprising:

a nozzle body defining a fire fighting fluid conduit terminating in a variable discharge orifice, the orifice automatically varying within a variable range, between a minimum and a maximum opening, at least in part in response to variation in fire fighting fluid pressure so as to maintain a selected) fire fighting fluid discharge pressure, the fire fighting fluid conduit and discharge orifice surrounding an attached dry chemical or foam concentrate conduit and chemical or foam discharge orifice; and selectively variable means for varying the range of automatic adjustment of the orifice at or downstream of the fire fighting fluid adjustable discharge orifice.

16. The apparatus of claim 1, 4, 11 or 15 wherein the nozzle is a self-educting foam fog nozzle providing the foam concentrate discharge orifice immediately downstream of the fire fighting fluid discharge orifice, the discharge orifices structured in combination such that the foam discharge orifice discharges into the discharge from the fire fighting fluid discharge orifice.

17. A method of operating an automatic dual fluid fire fighting nozzle subject to varying supply pressures comprising:

targeting a flow rate less than a maximum flow rate possible for the nozzle when operating at a standard supply pressure, by adjusting a stop located at or downstream of a fire fighting fluid discharge orifice;

maintaining approximately a constant fire fighting fluid discharge pressure for fire fighting fluid flow rates less than and up to approximately said targeted flow rate;

allowing fluid discharge pressure to rise above the constant discharge pressure for fire fighting fluid flow rates at or above the targeted flow rate, thereby maintaining fluid flow rate approximately constant;

metering foam concentrate in preselected proportions into a targeted fire fighting fluid flow rate at the nozzle; and discharging foam concentrate into the fire fighting fluid proximate the fire fighting fluid orifice discharge.

18. The method of claim 7 that includes allowing pressure to rise by selectively varying a range of an automatically adjustable discharge orifice.

19. The method of claims 17 or 18 that includes educting foam concentrate into the nozzle.

20. The method of claim 17 that includes adjustably metering foam concentrate into the nozzle as the discharge orifice adjusts.

21. The method of claim 5 or 17 that includes allowing pressure to rise by limiting adjustment of an automatically adjustable discharge orifice within an effective range of adjustment of the orifice.

22. A selectively automatic, dual fluid fire fighting nozzle, comprising:

a nozzle body defining a fire fighting fluid conduit terminating in a variable discharge orifice, the adjustable orifice automatically varying between a minimum and a maximum, at least in part in response to variation in fire fighting fluid pressure, so as to maintain a selected fire fighting fluid discharge pressure, the fire fighting fluid conduit and discharge orifice surrounding an attached dry chemical or foam concentrate conduit and chemical or foam discharge orifice;

nozzle elements adjustable to selectively vary a range of automatic adjustment of the discharge orifice; and wherein a flow window is defined by a maximum range of adjustment of the discharge orifice and wherein at least one nozzle element is adjustably locatable on the nozzle body, at or downstream of the fire fighting fluid variable discharge orifice, to divide the flow window such that the nozzle flows at a variable flow rate and at approximately a constant pressure for lower flow rates and at a variable pressure and relatively constant flow rate for higher flow rates.

23. A selectively automatic, dual fluid fire fighting nozzle, comprising:

a nozzle body defining a fire fighting fluid conduit terminating in a variable discharge orifice the fire fighting fluid conduit and discharge orifice surrounding an attached dry chemical or foam concentrate conduit and chemical or foam discharge orifice;

the variable discharge orifice, automatically varying, in response at least in part to fire fighting fluid pressure, over a range of openings defined by nozzle elements at or downstream of the fire fighting fluid variable discharge orifice, so as to maintain a selected fire fighting fluid discharge pressure; and the range having a selectively variable maximum position.

24. The nozzle of claim 23 wherein the nozzle elements include a floating baffle and at least one nozzle element at or downstream of the fire fighting fluid variable discharge orifice which; limits a forward motion of the floating baffle.

25. A method of operating an automatic, dual fluid fire fighting nozzle subject to varying supply pressures comprising:

selecting a targeted fluid flow rate for the nozzle, the target being below a maximum flow rate for the nozzle, the maximum being defined at least in part by a maximum selectively variable opening of a discharge orifice of the nozzle , by adjusting a stop located at or downstream of the discharge orifice;

maintaining approximately a selected fire fighting fluid discharge pressure for fire fighting fluid flowing through the nozzle for fluid flow rates below and up to the targeted flow rate;

allowing fluid discharge pressure to rise above the selected discharge pressure while maintaining fluid flow rate approximately constant upon reaching and exceeding said targeted flow rate;

allowing said pressure to rise by limiting adjustment of an automatically adjustable discharge orifice within a selectively variable range of adjustment of the orifice;

metering foam concentrate in preselected proportions into a targeted fire fighting fluid flow rate at the nozzle; and discharging foam concentrate into the fire fighting fluid proximate the variable discharge orifice.

26. A selectively automatic, dual fluid fire fighting nozzle, comprising:

a nozzle body defining a fire fighting fluid conduit terminating in an adjustable discharge orifice, the fire fighting fluid conduit and discharge orifice surrounding an attached dry chemical or foam concentrate conduit and chemical or foam discharge orifice;

the adjustable discharge orifice defined at least in part by elements that relatively adjust automatically, over a range and at least in part by elements that relatively adjust automatically to target a selected firefighting fluid pressure over at least a portion of the range; and a stop connected to the nozzle body, at or downstream of the fire fighting fluid adjustable discharge orifice, selectively adjustable to limit a range of automatic relative adjustment between orifice defining elements.

27. A selectively automatic, dual fluid fire fighting nozzle, comprising:

a nozzle body defining a fire fighting fluid conduit terminating in an adjustable discharge orifice;

the discharge orifice automatically adjustable within a range so as to maintain a selected fire fighting fluid discharge pressure, the fire fighting fluid conduit and discharge orifice surrounding an attached dry chemical or foam concentrate conduit and chemical or foam discharge orifice; and selectively adjustable means at or downstream of the fire fighting fluid adjustable discharge orifice, for limiting the range of automatic adjustment of the orifice.

* * * * *

UNITED STATES PATENT AND TRADEMARK OFFICE

CERTIFICATE OF CORRECTION

PATENT NO. : 7,784,709 B1
APPLICATION NO. : 10/380750
DATED : August 31, 2010
INVENTOR(S) : Williams et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1685 days.

Signed and Sealed this
Seventeenth Day of May, 2011

David J. Kappos

David J. Kappos
*Director of the United States Patent and Trademark Office*